US007390178B2

(12) United States Patent
Baba et al.

(10) Patent No.: US 7,390,178 B2
(45) Date of Patent: Jun. 24, 2008

(54) COMPRESSOR

(75) Inventors: Hiroshi Baba, Isesaki (JP); Kouji Takizawa, Isesaki (JP); Yoshinobu Ichikawa, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 450 days.

(21) Appl. No.: 10/967,196

(22) Filed: Oct. 19, 2004

(65) Prior Publication Data

US 2005/0100467 A1 May 12, 2005

(30) Foreign Application Priority Data

Nov. 6, 2003 (JP) ..... 2003-377491

(51) Int. Cl.
*F04B 1/12* (2006.01)
*F04B 27/08* (2006.01)
*F04B 39/10* (2006.01)
*F04B 53/10* (2006.01)

(52) U.S. Cl. ..... 417/571; 417/269; 417/569; 91/499

(58) Field of Classification Search ..... 91/499; 417/269, 571, 569
See application file for complete search history.

(56) References Cited

U.S. PATENT DOCUMENTS 4,360,319 A * 11/1982 Paget ..... 417/571
4,642,037 A * 2/1987 Fritchman ..... 417/571
5,380,176 A 1/1995 Kikuchi et al.
5,586,874 A 12/1996 Hashimoto et al.
5,647,395 A 7/1997 Hashimoto et al.
5,655,898 A 8/1997 Hashimoto et al.
6,006,786 A 12/1999 Ito
6,318,980 B1 * 11/2001 Kurihara et al. ..... 417/571

FOREIGN PATENT DOCUMENTS

EP 0774582 B1 5/1997
JP 573276 8/1993
JP 0573276 U 10/1993
JP 625576 8/1994

OTHER PUBLICATIONS

German Patent and Trademark Office, Office Action (Counterpart Appl'n), Nov. 11, 2005.

* cited by examiner

*Primary Examiner*—Charles G Freay
*Assistant Examiner*—Patrick Hamo
(74) *Attorney, Agent, or Firm*—Baker Botts, L.L.P.

(57) ABSTRACT

A compressor comprises a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve. The divergences of the outlet valves restricted by the retainers are different from each other.

4 Claims, 4 Drawing Sheets

COMPRESSOR

BACKGROUND OF THE INVENTION

The present invention relates to a compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve.

Japanese Utility Model Laid-Open Publication No. 05-073276 discloses a compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve.

In the aforementioned compressor, the retainer restricts the distance of lift of the outlet valve when the outlet valve opens i.e., divergence of the outlet valve to prevent the divergence from becoming too large, thereby controlling noise generating when the outlet valve touches the valve seat.

The compressor disclosed in Japanese Utility Model Laid-Open Publication No. 05-073276 has a problem in that all the outlet valves are forced to have the same divergence to behave in the same manner and vibrate with the same frequency, thereby causing a marked vibration of the compressor and pulsation of the gas with the aforementioned specific frequency of the vibration of the outlet valves.

SUMMARY OF THE INVENTION

An object of the present invention is to provide a compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve, wherein vibrations of the outlet valves do not cause a marked vibration of the compressor and pulsation of the gas with a specific frequency.

In accordance with the present invention, there is provided a compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve, wherein the divergences of the outlet valves restricted by the retainers are different from each other.

In accordance with another aspect of the present invention, there is provided a compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve, wherein the outlet valves are assigned to a plurality of groups and the divergences of the outlet valves are different from group to group.

In the compressor of the present invention, behaviors of the outlet valves when they open are different from each other or different from group to group and the frequencies of the vibrations of the outlet valves when they open are different from each other or different from group to group because the divergences of the outlet valves restricted by the retainers are different from each other or different from group to group. Therefore, the vibrations of the outlet valves cause neither marked vibration of the compressor with a specific frequency nor marked pulsation of the gas with a specific frequency.

In accordance with a preferred embodiment of the present invention, the divergence restricting surfaces of the retainers incline in the transverse directions of the corresponding outlet valves.

When the divergence restricting surfaces of the retainers incline in the transverse directions of the corresponding outlet valves, the outlet valves approach close to the divergence restricting surfaces of the retainers to incline transversely and the distances of the lifts of the outlet valves increase from one transverse ends to the other transverse ends of the valves to lead gas flows discharging from the outlet holes to the other transverse ends of the outlet valves, thereby stabilizing the gas flows. As a result, behaviors of the outlet valves are stabilized and generation of unpleasant noises is prevented.

DETAILED DESCRIPTION OF THE PREFERRED EMBODIMENTS

A swash plate compressor in accordance with a preferred embodiment of the present invention will be described.

Figure 1:
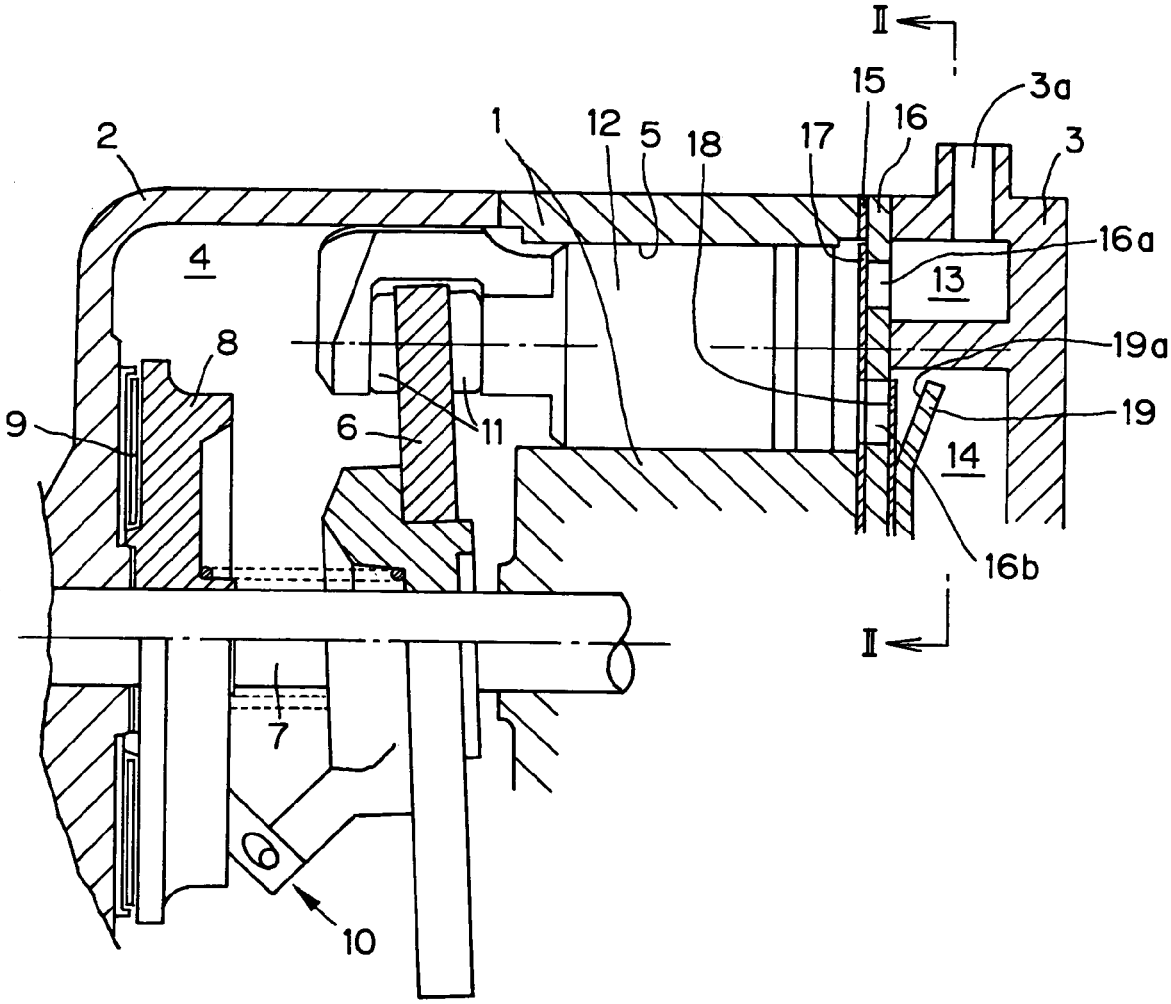
FIG. 1 is a fragmentary sectional view of a swash plate compressor in accordance with a preferred embodiment of the present invention.

As shown in FIG. 1, a column-shaped cylinder block 1 is covered by a front housing 2 at one end and a cylinder head 3 at the other end. A crank chamber 4 is formed in the front housing 2. A plurality of cylinder bores 5 are formed in the cylinder block 1 circumferentially spaced from each other. A swash plate 6 is disposed in the crank chamber 4. A driving shaft 7 passes through the center of the swash plate 6. The driving shaft 7 is rotatably supported on the front housing 2 and the cylinder block 1 by bearings not shown in Figures.

A rotor 8 is fixed to the driving shaft 7. The rotor 8 is supported on the front housing 2 by a thrust bearing 9.

The swash plate 6 is connected to the rotor 8 through a linkage 10 to be variable in inclination relative to the driving shaft 7 and incapable of rotation around the driving shaft 7 relative to the rotor 8.

A plurality of pistons 12 engage the swash plate 6 through a plurality of pairs of shoes 11. The pistons 12 extend parallel to the driving shaft 7 to be accommodated in the cylinder bores 5, thereby moving reciprocally.

An inlet chamber 13 and an outlet chamber 14 are formed in the cylinder head 3. The inlet chamber 13 communicates with an inlet port 3*a* formed in the cylinder head 3 and the outlet chamber 14 communicates with an outlet port formed in the cylinder head 3. The outlet port is not shown in the Figures.

Figure 2:
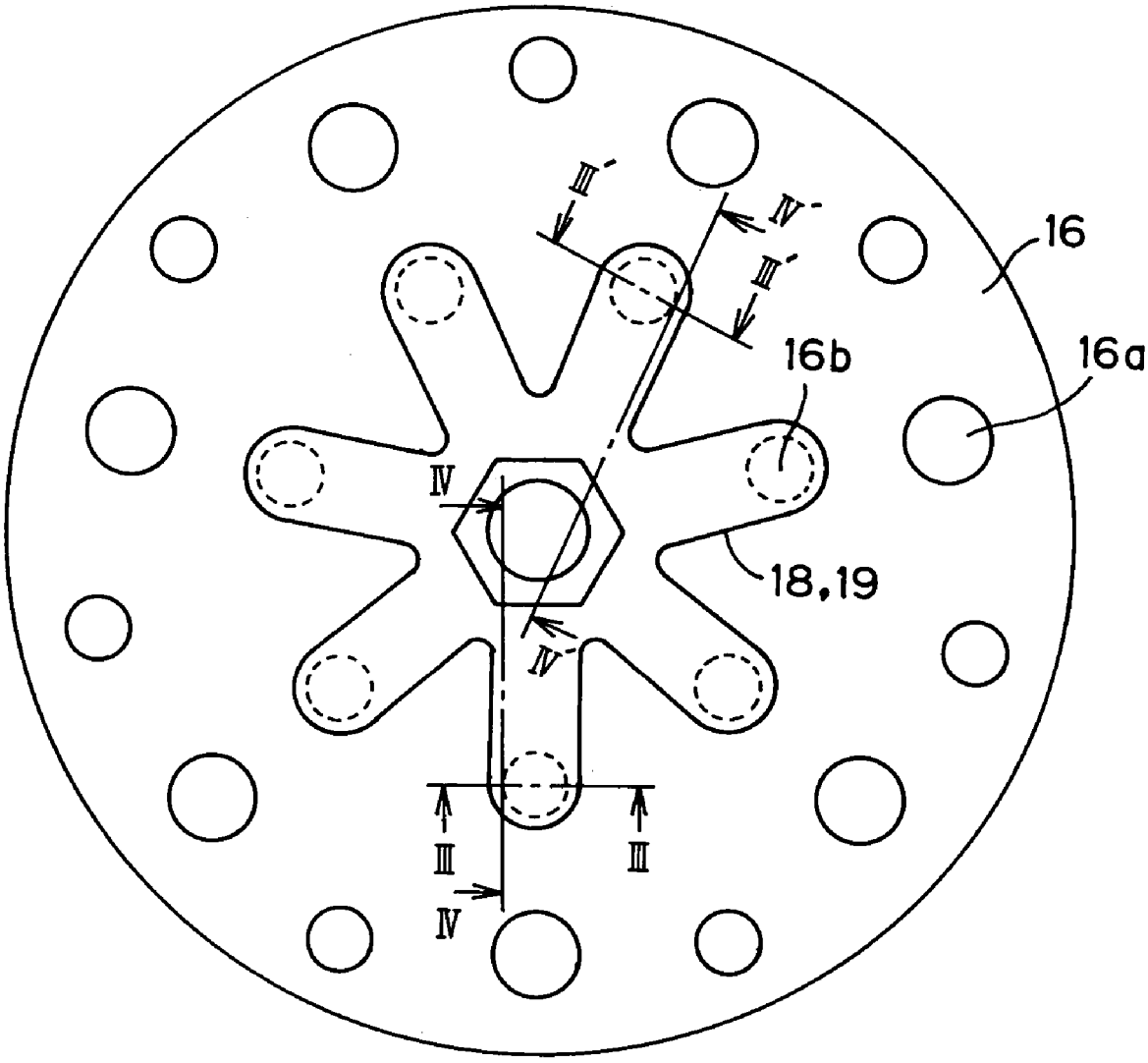
FIG. 2 is a view in the direction of arrows II-II in FIG. 1.

A gasket 15 and a valve plate 16 are disposed between the cylinder block 1 and the cylinder head 3 to be clamped by them. The valve plate 16 is provided with a plurality of inlet holes 16*a* and a plurality of outlet holes 16*b*. The inlet holes 16*a* communicate with the cylinder bores 5 and the inlet chamber 13. The outlet holes 16*b* communicate with the cylinder bores 5 and the outlet chamber 14. The valve plate 16 is provided with a plurality of inlet valves 17 disposed on the surface distant from the inlet chamber 13 to open and close the inlet holes 16*a*. The valve plate 16 is provided with a plurality of outlet valves 18 disposed on the surface opposing the outlet chamber 14 to open and close the outlet holes 16*b*. The inlet valves 17 are strap-shaped reed valves, each whereof is made free at one longitudinal end opposing a corresponding one of the inlet holes 16*a*, and receives pressure difference between the cylinder bore 5 and the inlet chamber 13 to deform out of plane, thereby opening and closing the inlet hole 16*a*. The outlet valves 18 are strap-shaped reed valves, each whereof is made free at one longitudinal end opposing a corresponding one of the outlet holes 16*b*, and receives pressure difference between the cylinder bore 5 and the outlet chamber 14 to deform out of plane, thereby opening and closing the outlet hole 16*b*. As shown in FIG. 2, the outlet valves 18 extend in the radial direction and are integrated in a unitary body at the other longitudinal ends i.e., the inner ends in the radial direction. The inlet valves 17 extend in the radial direction and are integrated in a unitary body at the other longitudinal ends i.e., the inner ends in the radial direction, in the same manner as the outlet valves 18.

A plurality of retainers 19 are disposed in the outlet chamber 14. Each of the retainers 19 extends in the same direction as a corresponding one of the outlet valves 18 and is provided with a divergence restricting surface 19*a* opposing the valve plate 16 with the corresponding outlet valve 18 extending between the surface and the valve plate 16 to restrict the divergence of the corresponding outlet valve 18. As shown in FIG. 2, the retainers 19 extend in the radial direction and are integrated in a unitary body at their bases i.e., their inner ends in the radial direction.

The inner ends in the radial direction of the inlet valves 17, the outlet valves 18 and the retainers 19 are fixed to the cylinder block 1 by a bolt.

Figure 3A:
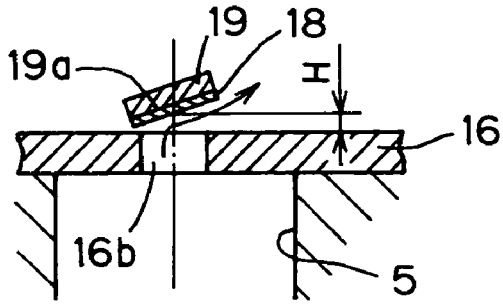
FIG. 3 is a combination of a view in the direction of arrows III-III in FIG. 2 and a view in the direction of arrows IV-IV in FIG. 2, wherein (a) is a view in the direction of arrows III-III in FIG. 2 and (b) is a view in the direction of arrows IV-IV in FIG. 2.
Figure 3B:
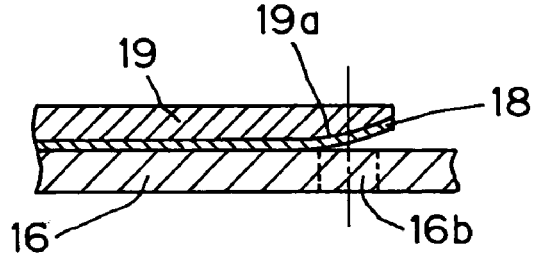
Figure 4A:
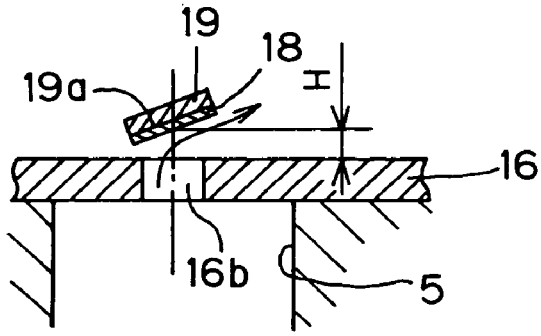
FIG. 4 is a combination of a view in the direction of arrows III'-III' in FIG. 2 and a view in the direction of arrows IV'-IV' in FIG. 2, wherein (a) is a view in the direction of arrows III'-III' in FIG. 2 and (b) is a view in the direction of arrows IV'-IV' in FIG. 2.
Figure 4B:
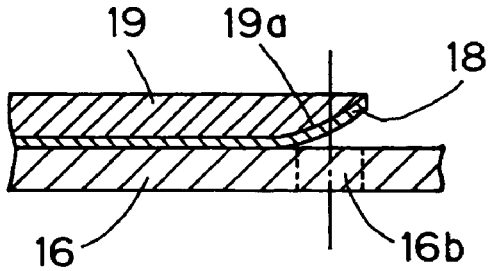

As shown in FIGS. 3 and 4, the divergence restricting surface 19*a* inclines in the longitudinal direction and the transverse direction of the outlet valve 18. The divergences H of the outlet valves 18 restricted by the retainers 19, i.e., the distances of lifts of the outlet valves 18 from the valve plate 16 measured along the centerlines of the corresponding outlet holes 16*b* when the outlet valves 18 approach close to the divergence restricting surfaces 19*a* of the retainers 19, are different from each other.

The operation of the swash plate compressor in accordance with the present preferred embodiment will be described with attention paid to a specific one of the cylinder bores 5 and members corresponding to the specific bore 5.

The driving shaft 7 is driven to rotate by an external power source not shown in Figures and the swash plate 6 rotates following the rotation of the driving shaft 7. The piston 12 moves reciprocally in the cylinder bore 5 following the rotation of the swash plate 6. Refrigerant gas enters into the inlet chamber 13 from an external refrigerant circuit through the inlet port 3*a* following the reciprocal movement of the piston 12. The refrigerant gas is sucked into the cylinder bore 5 through the inlet hole 16*a* and pressurized in the cylinder bore 5. The pressures of the refrigerant gas in the cylinder bore 5 increases, the outlet valve 18 receiving the pressure of the refrigerant gas in the cylinder bore 5 deforms out of plane to abut on the divergence restricting surface 19*a* of the retainer 19 at one transverse side end. The outlet valve 18 receiving dynamic pressure from the refrigerant gas blowing out the cylinder bore 5 is twisted around the transverse center, i.e., the center of twist, to incline transversely, thereby approaching close to the divergence restricting surface 19*a* as shown in FIG. 3. The outlet hole 16*b* opens. The pressurized refrigerant gas in the cylinder bore 5 discharges into the outlet chamber 14 through the outlet hole 16*b* and a discharging passage formed between the outlet valve 18 and the valve plate 16, and then discharges from the outlet chamber 14 into the external refrigerant circuit through the outlet port not shown in Figures.

In the swash plate compressor in accordance with the present preferred embodiment, divergences H of the outlet valves 18 restricted by the retainers 19 are different from each other. Therefore, behaviors of the outlet valves 18 during the transition between the closed condition wherein the outlet valves 18 contact the valve plate 16 to the open condition wherein the outlet valves 18 approach close to the divergence restricting surfaces 19*a* of the retainers 19, more concretely, the elapsed deformations of the portions of the outlet valves 18 free from the retainers 19 and capable of vibrating, are different from each other. Therefore, the frequencies of the most marked vibrations of the outlet valves 18 during the transition between the closed conditions to the open conditions of the outlet valves 18 are different from each other. As a result, the vibrations of the outlet valves 18 do not cause a marked vibration of the compressor with a specific frequency or a marked pulsation of the refrigerant gas with a specific frequency.

In the swash plate compressor in accordance with the present preferred embodiment, the divergence restricting surface 19*a* of the retainer 19 inclines in the transverse direction of the outlet valve 18. Therefore, the outlet valve 18 approaches close to the divergence restricting surface 19*a* to incline transversely, and the distance of lift of the outlet valve 18 increases from one transverse side end to the other transverse side end. As a result, the discharging flow of the refrigerant gas is led to the other transverse side end of the outlet valve 18 as shown by an arrow in FIGS. 3 and 4 to be stabilized. Thus, the behavior of the outlet valve 18 is stabilized and generation of unpleasant noise is prevented.

Figure 5A:
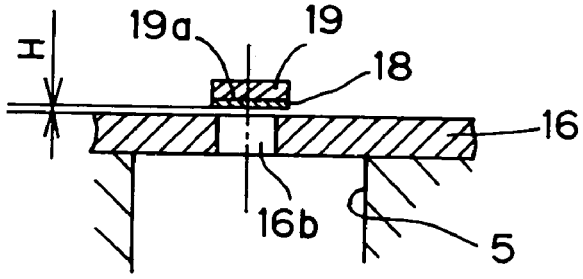
FIG. 5 is a combination of views corresponding to FIG. 3 of a compressor in accordance with another preferred embodiment of the present invention.
Figure 5B:
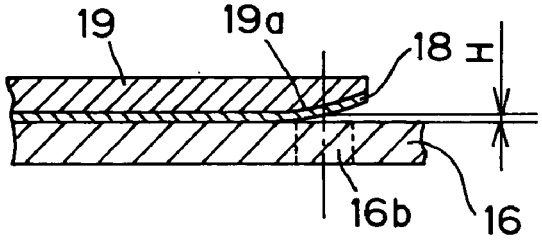
Figure 6A:
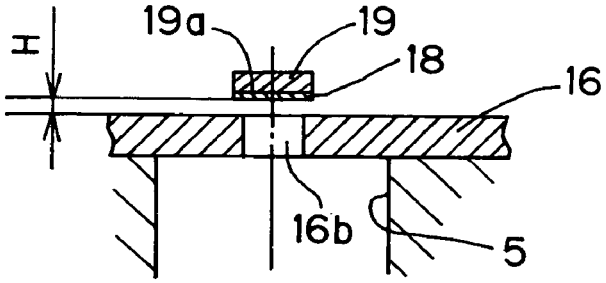
FIG. 6 is a combination of views corresponding to FIG. 4 of a compressor in accordance with another preferred embodiment of the present invention.
Figure 6B:
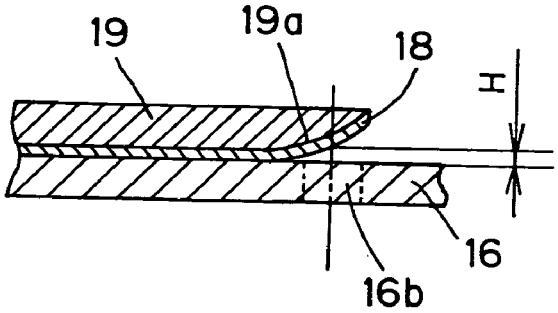

It is possible to make the divergence restricting surfaces 19*a* incline only in the longitudinal direction and make the divergences H of the outlet valves 18 restricted by the retainers 19 different from each other as shown in FIGS. 5 and 6.

In this case, divergences H of the outlet valves 18 restricted by the retainers 19 are different from each other. Therefore, behaviors of the outlet valves 18 during the transition between the closed conditions wherein the outlet valves 18 contact the valve plate 16 to the open conditions wherein the outlet valves 18 approach close to the divergence restricting surfaces 19*a* of the retainers 19 are different from each other. Therefore, the frequencies of the most marked vibrations of the outlet valves 18 during the transition between the closed conditions to the open conditions of the outlet valves 18 are different from each other. As a result, the vibrations of the outlet valves 18 do not cause a marked vibration of the compressor with a specific frequency or a marked pulsation of the refrigerant gas with a specific frequency.

It is possible to assign the outlet valves 18 to a plurality of groups comprising one or more outlet valves 18 and make the divergences H of the outlet valves 18 different from group to group.

In this case, divergences H of the outlet valves 18 restricted by the retainers 19 are different from group to group comprising one or more outlet valves 18. Therefore, behaviors of the outlet valves 18 during the transition between the closed conditions wherein the outlet valves 18 contact the valve plate 16 to the open conditions wherein the outlet valves 18 approach close to the divergence restricting surfaces 19*a* of the retainers 19 are different from group to group, and the frequencies of the most marked vibrations of the outlet valves 18 during the transition between the closed conditions to the open conditions are different from group to group. As a result, the vibrations of the outlet valves 18 do not cause a marked vibration of the compressor with a specific frequency or a marked pulsation of the refrigerant gas with a specific frequency.

The grouping of the outlet valves 18 is not required to be regular in the manner of, for example, assigning every other outlet valve 18 to one group and the remaining outlet valves 18 to another group.

The present invention is suitable for various kinds of compressors comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve.

While the present invention has been described with reference to preferred embodiments, one of ordinary skill in the art will recognize that modifications and improvements may be made while remaining within the spirit and scope of the present invention. The scope of the invention is determined solely by the attached claims.

The invention claimed is:

1. A compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve, wherein the divergences of the outlet valves restricted by the retainers, and the distance between the outlet holes and the free longitudinal ends of the corresponding outlet valves, are different from each other.

2. A compressor comprising a plurality of pairs of a cylinder bore and a piston moving reciprocally in the cylinder bore, a valve plate provided with a plurality of outlet holes for leading pressurized gas in the cylinder bores to the outside, a plurality of strap-shaped outlet valves, each whereof is free at one longitudinal end opposing a corresponding one of the outlet holes to open and close it, and a plurality of retainers, each whereof extends in the same direction as a corresponding one of the outlet valves and is provided with a divergence restricting surface opposing the valve plate with the corresponding outlet valve extending between the surface and the valve plate to restrict the divergence of the corresponding outlet valve, wherein the outlet valves are assigned to a plurality of groups and the divergences of the outlet valves, and the distance between the outlet holes and the free longitudinal ends of the corresponding outlet valves, are different from group to group.

3. A compressor of claim 1, wherein the divergence restricting surfaces of the retainers incline in the transverse directions of the corresponding outlet valves.

4. A compressor of claim 2, wherein the divergence restricting surfaces of the retainers incline in the transverse directions of the corresponding outlet valves.

* * * * *